United States Patent [19]

Deutsch et al.

[11] 4,354,414

[45] Oct. 19, 1982

[54] CONSTANT SPEED POLYPHONIC PORTAMENTO SYSTEM

[75] Inventors: Ralph Deutsch, Sherman Oaks; Leslie J. Deutsch, Glendale, both of Calif.

[73] Assignee: Kawai Musical Instrument Mfg. Co., Ltd., Hamamatsu, Japan

[21] Appl. No.: 203,021

[22] Filed: Nov. 3, 1980

[51] Int. Cl.³ ..... G10H 1/02

[52] U.S. Cl. ..... 84/1.24; 84/1.03

[58] Field of Search ..... 84/1.24, 1.01, 1.03

[56] References Cited

U.S. PATENT DOCUMENTS 4,131,049 12/1978 Okumura et al. ..... 83/1.01

4,240,318 12/1980 Gross ..... 84/1.24

*Primary Examiner*—J. V. Truhe

*Assistant Examiner*—Forester W. Isen

*Attorney, Agent, or Firm*—Ralph Deutsch

[57] ABSTRACT

A keyboard operated electronic musical instrument with polyphonic portamento and glissando effects in which each key controls one of a number of tone generators through a table of frequency numbers. The frequency transitions are achieved by subtracting the frequency number of a new note from the frequency number controlling the current frequency of an assigned tone generator. A predetermined fraction of the difference is stored in increment registers and added successively to the frequency numbers of the current notes until these numbers are equal to the frequency number of the new note. The addition rate, which determines the frequency transition time, is adjustable by means of a variable frequency time clock. The assignment of the tone generators to the actuated keyswitches is accomplished in a manner which prevents objectionable frequency cross-over transitions even when the number of notes in successive chords is changed.

15 Claims, 4 Drawing Figures

CONSTANT SPEED POLYPHONIC PORTAMENTO SYSTEM

BACKGROUND OF THE INVENTION

1. Field of the Invention

This invention relates to electronic musical instruments of the tone synthesizer type and in particular is concerned with provision for providing a polyphonic portamento effect in a digitally controlled tone synthesizer.

2. Description of the Prior Art

Portamento is a musical effect which is almost universally incorporated as a feature of electronic musical instruments of the synthesizer variety. Generally the portamento mode is limited to monophonic tone generation which is adequate for most synthesizer tone generators.

Two principal types of portamento system operational modes have been implemented in prior systems. The first mode can be categorized as a continuous tone mode. In the first operational mode, the tone generation starts when a keyboard keyswitch is actuated and the keyboard has been placed in the portamento operational status. The tone continues even when the keyswitch is released and continues to sound a note at the corresponding keyswitch pitch until a new keyswitch is actuated. When a new keyswitch is actuated, the musical pitch of the generated tone gradually changes to that of the new note in a manner that "sounds" like a continuous smooth frequency transition. The frequency transition speed is preset by a variable musical console control. Usually the frequency transition takes place as a constant frequency change per unit time. A variation is to cause the frequency transition speed to be proportional to the frequency change between the old and new frequencies.

The second operational mode is one in which each actuated note has its own complete ADSR envelope modulation. When a new keyboard keyswitch is actuated, a new note will be initialed which has a pitch that changes smoothly from that of the previously operated keyswitch. At the time of the keyswitch actuation, an attack phase of the ADSR envelope is initiated for the new note.

An example of a monophonic portamento system is disclosed in the U.S. Pat. No. 4,103,581 entitled "Constant Speed Portamento."

The current trend in the design of electronic musical instruments is to implement polyphonic tone generators each member of which is a tone synthesizer. Portamento systems designed for monophonic operation are not readily incorporated into polyphonic systems. A system problem arises if the polyphonic musical instrument is implemented by having a few tone generators that are assigned to any of the actuated keyswitches on the musical instrument's keyboard. Tone generator problems arise when portamento is implemented in such instruments because of the necessity of assigning currently unused tone generators to newly actuated keyboard switches.

A problem in polyphonic portamento systems using the assignment of a number of tone generators arises when a chord is played and is then followed by a chord in which the number of component notes differs from that of the first chord. This problem of generator assignment and portamento frequency transition is made further complex if the second set of notes in the new chord are not actuated simultaneously. These conditions can readily result in portamento frequency transitions which can produce objectionable "non-musical" dissonances.

It is an object of this invention to provide means for assigning a set of tone generators operating in a polyphonic portamento mode such that frequency transitions to new notes are made without dissonances produced by frequency cross over transitions.

It is a further object of this invention to automatically reassign tone generators if new notes are actuated before the completion of a portamento frequency transition in a fashion which eliminates the chance of a dissonant frequency cross over.

SUMMARY OF THE INVENTION

The present invention is directed to an arrangement for producing polyphonic portamento frequency transitions of musical tones generated by a keyboard operated electronic musical instrument.

In brief this is accomplished by implementing a number of portamento tone generators each of which includes an accumulator for storing a frequency number. The frequency number in the accumulator in turn is applied to a digital-to-analog converter. The analog voltage level from the converter is used to determine the frequency of a voltage controlled oscillator. The output timing pulses generated by the voltage controlled oscillator determines the fundamental frequency of the associated musical tone generator. As each new note is actuated on the keyboard, a frequency assignor assigns the frequency numbers in a particular way to each of the portamento tone generators. When a new frequency number is assigned to a tone generator it is subtracted from the previous frequency number contained in its accumulator. The frequency number difference is divided by a preselected constant value to form an incremental value which is a fraction of the difference between the old and present frequency numbers. This incremental value is then added or subtracted from the frequency number in the accumulator at repeated intervals to increment or decrement the number in the accumulator in steps until the value in the accumulator corresponds to the new frequency number. With each incremental change of the number in the accumulator, the frequency of the voltage controlled oscillator shifts by a corresponding incremental amount from the frequency of the previous note until the number in the accumulator corresponds to the frequency number of the new note. The keyboard switches are scanned sequentially from the highest notes to the lowest notes. For each detected keyboard switch closure, a frequency number is accessed from a frequency number table and assigned to one of the portamento generators by means of the frequency assignor. The first detected note on a scan of the keyboard switches, corresponding to the highest frequency actuated keyswitch, causes the corresponding frequency number to be stored in all of the portamento tone generators. If there are at least two simultaneously actuated keyswitches, the frequency assignor will cause the frequency number corresponding to the second highest note to be stored in all of the portamento tone generators except for one which will maintain storage of the frequency number corresponding to the highest note. This multiple frequency number assignment with highest note priority is continued until all the actuated keyswitches have been accomodated or until all the available portamento tone generators have been assigned.

BRIEF DESCRIPTION OF THE DRAWINGS

For a better understanding of the invention reference should be made to the accompanying drawings.

DETAILED DESCRIPTION OF THE INVENTION

In U.S. Pat. No. 4,085,644 entitled "Polyphonic Tone Synthesizer" there is described a musical tone generating system in which one of a plurality of tone generators is assigned to a musical note corresponding to the actuation of a keyswitch on a keyboard comprising an array of keyswitches. This patent is hereby incorporated by reference. As each keyswitch is actuated on the keyboard, data identifying the note and key assignment status is stored in a Read/Write assignment memory. The identification of the note consists of encoding a binary number, called the detection signal, with the note number within a musical octave, the octave number for a selected keyboard, and a number identifying the keyboard. This function is incorporated into the note detect and assignor 14 shown in FIG. 1. A suitable arrangement for the note detect and assignor is described in U.S. Pat. No. 4,022,098 entitled "Keyboard Switch Detect And Assignor" which is hereby incorporated by reference.

Once a keyswitch is assigned to a tone generator, the pitch of the generated musical tone is determined by a voltage controlled oscillator which is a component of the tone generator. The pitch is determined by note information generated by the note detect and assignor 14 when an actuated keyswitch is detected and encoded on the detection signal. A method of controlling the frequency of the voltage controlled oscillators for each tone generator is described in detail in U.S. Pat. No. 4,067,254 entitled "Frequency Number Controlled Clocks" which is hereby incorporated by reference.

An assignment problem exists for a polyphonic portamento system. This problem occurs when a chord of a few notes is played and is then followed by a chord in which the number of constituent notes has been changed. This change can lead to the production of undesired frequency transitions for the assigned tone generators.

Figure 2:
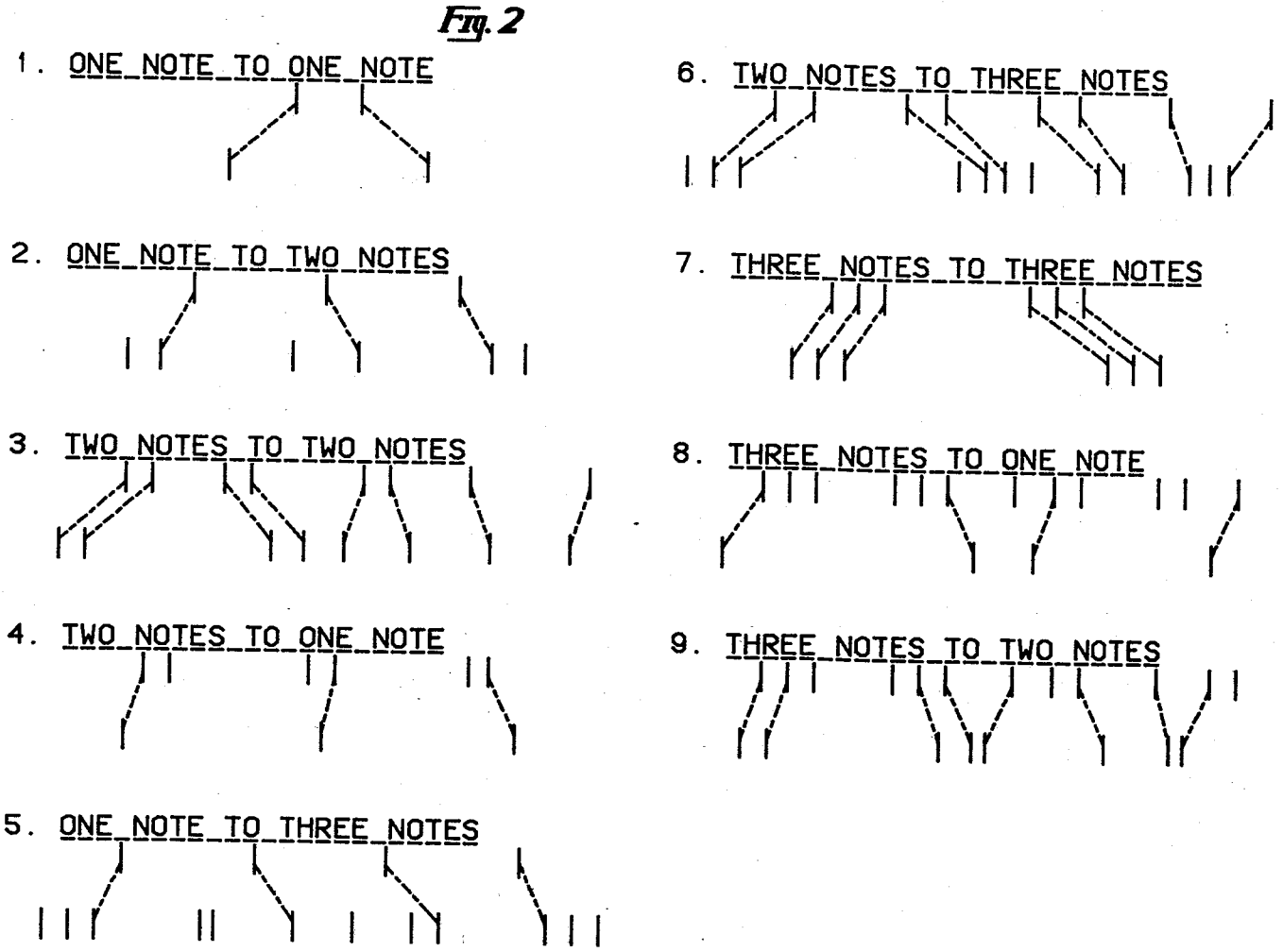
FIG. 2 is a schematic diagram of chord frequency transitions.

FIG. 2 illustrates some chord transitions between a first and second actuated chord. For illustrative purposes it is assumed that there are only three tone generators assigned to the keyboard that has been placed in the portamento operation mode. This number does not represent a limitation or restriction of the invention as it is obvious that any desired number of tone generators can be used in the inventive fashion.

In FIG. 2 a set of transitions are shown for a number of cases for a first actuated chord (top row of lines) followed by a second chord (bottom row of lines). For completeness, a single note is considered to be a one note chord. Each chord transition can have several cases as shown in FIG. 2. The dashed lines represent an advantageous selection of the possible frequency transitions. The horizontal axis in FIG. 2 is a frequency axis. Some possible cases have been omitted from FIG. 2 because these cases are essentially duplicates of those that are drawn.

For case 2, a single note is followed by a two note chord. Of the three possible transitions, the middle case is selected in a manner described below. This is a transition to the highest note of the second chord.

Cases 1 and 3 cause no problem.

For case 4, the second chord has one less note than the first chord. The second transition will be selected if it is a transition from the highest frequency of the first chord.

For case 5, the selected transition will be that of the first three subcases in which the transition will be made to the highest.

For each of the other cases, the subcases will be selected for which the transitions favor the highest frequencies.

Figure 1:
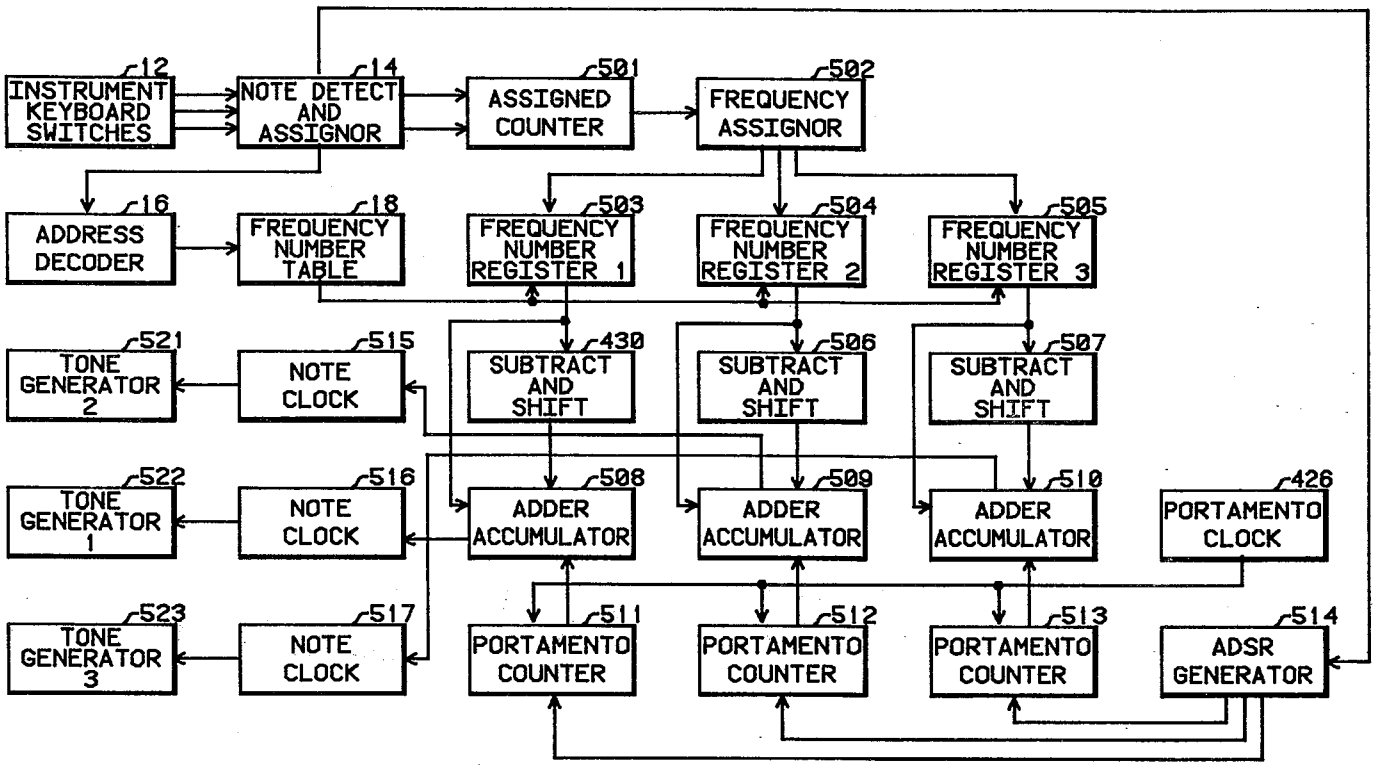
FIG. 1 is a schematic block diagram of an embodiment of the present invention.

The note detect and assignor 14 scans the instrument keyswitches in the direction of high notes to low notes. The instrument keyboard switches 12 comprise the common linear array of keyswitches for an organ-like musical instrument. The keyswitches are scanned in a sequence of keyswitch scans in the manner described in the referenced Pat. No. 4,022,098. The system shown in FIG. 1 is drawn for three tone generators that are associated with a keyboard that has been placed in a portamento operation mode. On each scan of a repetitive sequence of scans of the keyboard switches, the note detect and assignor 14 detects the actuated switches up to a maximum of three actuated switches. Any additional actuated keyswitches are ignored by the detection and frequency assignment logic.

The assigned counter 501 is implemented to count to three and remain at the three count stage until reset by the note detect and assignor 14. This counter is reset each time that a new scan is started for the keyswitches to detect switch closures. The assigned counter is incremented each time an actuated keyswitch is detected on the keyboard that is in the portamento operational mode.

For each detected keyboard switch closure (actuated keyswitch), a frequency number is accessed from a frequency number table 18 by the frequency assignor 502 and is stored in selected members of the set of three frequency number registers 503–505. The encoded detection is decoded to obtain the address for accessing the frequency number table 18. The detailed system logic for the frequency assignor 502 is shown in FIG. 3 and described below.

The first note detected on any scan of the keyboard, which will always be the highest note, causes a corresponding frequency number to be stored in each of the three frequency registers 503–505. The second detected note, if there are at least two actuated keyswitches, causes the frequency number corresponding to the second detected keyswitch closure to be stored in the frequency register 2 504 and the frequency register 3 505. The highest note's frequency number is left unaltered in the frequency number register 1 503. If a third keyswitch has been actuated, then its corresponding frequency number will be stored in the frequency number register 3 505.

The assignment of the frequency number registers can be designated by an assignment of frequency registers having an index number equal to or less than the number N+1−J. N is the total number of such registers and J is the number of keyswitch closures that have been detected since the start of a keyswitch scan. Each frequency register is assigned an index number in the numeric range of 1,2, . . . , N.

Figure 3:
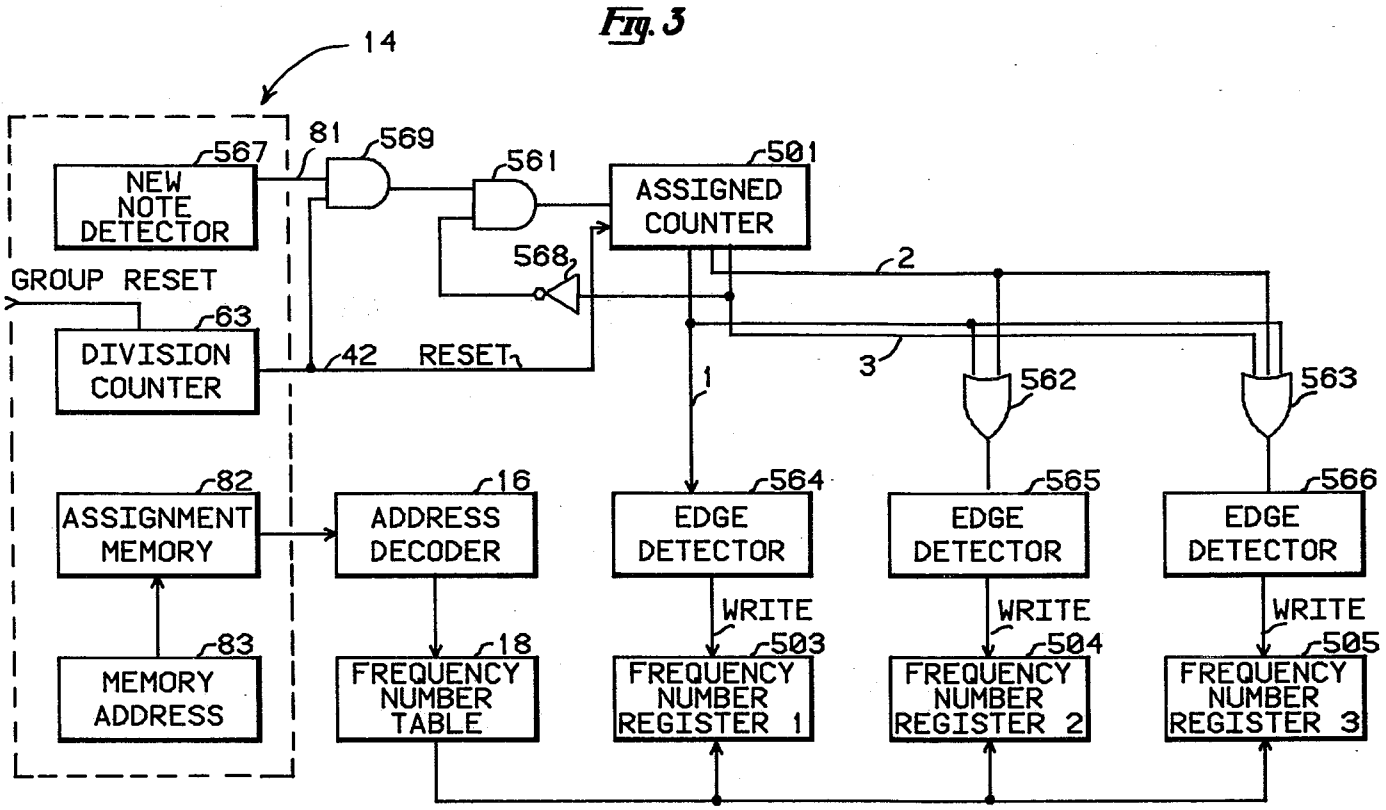
FIG. 3 is a schematic block diagram of the frequency assignor.

In FIG. 3, the logic blocks 567, 63, 82 and 83 are component elements of the note detect and assignor 14. As described in the referenced Pat. No. 4,022,098, when a keyswitch has been detected as being closed (actuated) on a current scan of the keyboard switches a detection signal is generated. The logic circuitry for this detection is shown symbolically in FIG. 3 as the logic block new note detector 567. The division counter 63 supplies a signal for each keyboard that is to be scanned for an instrument which may have a number of keyboards. For illustration purposes, it is assumed that the keyboard having the portamento mode corresponds to a "1" logic state on the line 42 furnished as one of the decoded output states of the division counter 63. Thus the output binary state of the AND-gate 569 will be "1" if a keyswitch closure has been detected for the keyboard that is in the portamento mode.

The AND-gate 561 will transfer the keyswitch closures to the assigned counter 501 if this counter is not in its third count state. The third count state is inverted by the invertor 568 and thereby retains the maximum of a three count until the counter is reset by a signal on line 42 that occurs at the start of a scan of the keyboard in the portamento mode.

Each actuated keyswitch causes its corresponding note, octave, and division data to be encoded and stored in the assignment memory 82. In response to a detected keyswitch closure this information is transmitted to the address decoder 16. The address decoder decodes the note and octave information to access a frequency number from the frequency number table 18. The frequency numbers are used to control the frequencies of the note clocks 515–517 in a manner such as that described in the referenced Pat. No. 4,067,254.

The binary states of the assigned counter 501 are decoded onto three lines. The first state is edge detected by the set of edge detectors 565–566 and used as a write control signal for the set of frequency number registers 503–505. Thus when the first, or highest, note is detected on the portamento keyboard the corresponding frequency number is stored in all the frequency number registers. When a second note has been detected, the assigned counter 501 is advanced to its second state. The second state is decoded on line 2 and causes the current frequency number to be stored in frequency number registers 504 and 505. When a third note is detected, the assigned counter 501 is advanced to its third count state which causes the current frequency number to be stored in the frequency number register 3 505.

Figure 4:
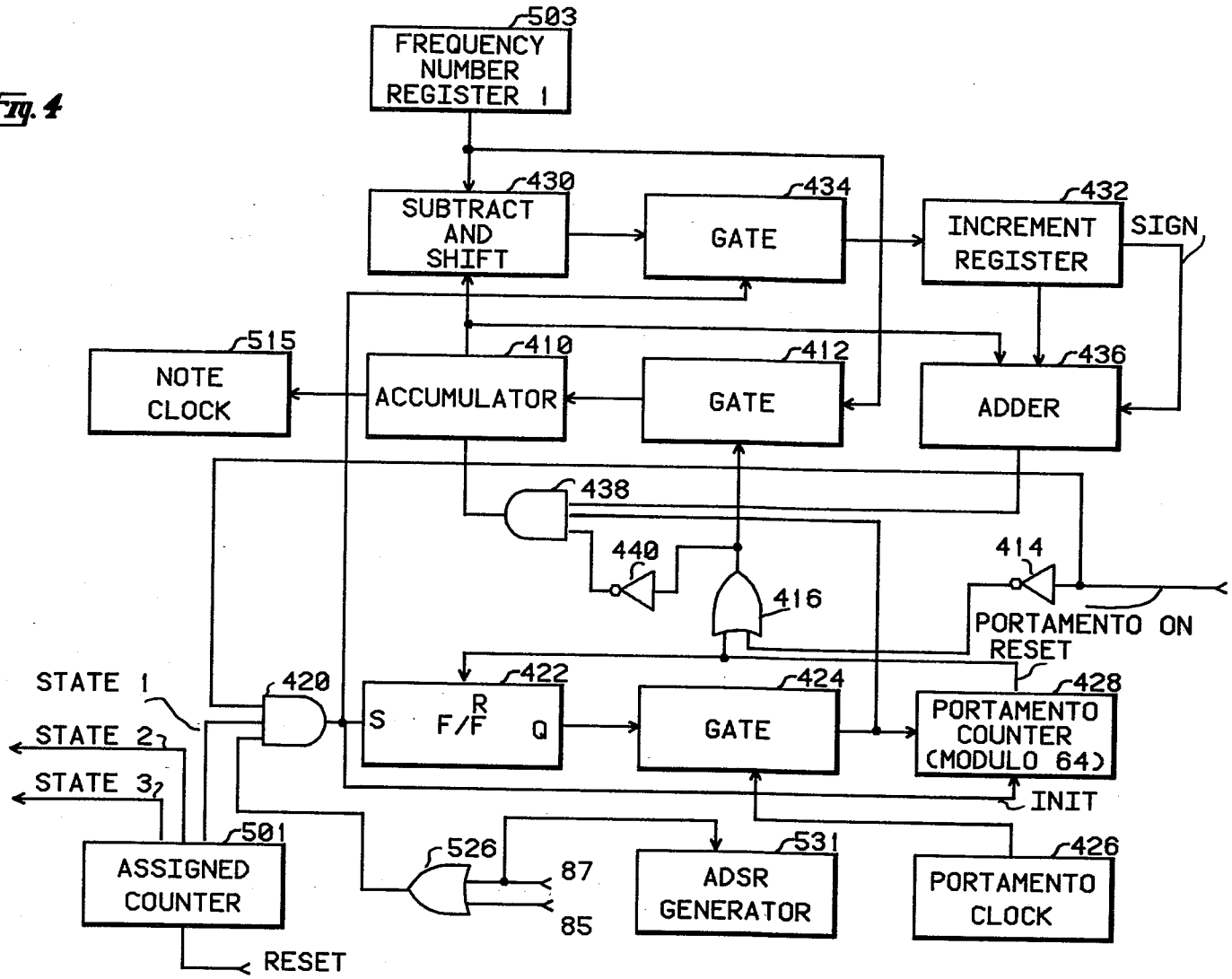
FIG. 4 is a schematic block diagram of the portamento frequency increment generator.

The generation of frequency number increments from the present and last assigned frequency number for a given tone generator is accomplished in a manner similar to that described in U.S. Pat. No. 4,103,581 entitled "Constant Speed Portamento" and which is hereby incorporated by reference. The detailed logic for the portamento control means is shown in FIG. 4 and is described below.

The note clock can alternatively be implemented to function as a noninteger frequency divider using the assigned frequency numbers. Such systems are described in U.S. Pat. No. 4,114,496 entitled "Note Frequency Generator For A Polyphonic Synthesizer." This patent is hereby incorporated by reference.

The above described frequency number assignment logic can be illustrated for the chord transition cases shown in FIG. 2.

Case 1: If only a single note chord transition is actuated, the same identical new frequency numbers will be assigned to the three frequency number registers 503–505. Although the three adder accumulators 508–510 will start incrementing to the same value as described later in connection with FIG. 4, there will only be one generated tone because only the ADSR (attack-decay-sustain-release) envelope modulation function corresponding to the first tone generator will be started. The ADSR envelope functions for the other two tone generators will remain at a zero output value so the net result is that the desired action of a single tone with portamento is established.

Case 2: Suppose that the first chord consists of a single note followed by a transition to a two note chord as shown for case 2. During the keyboard scans by the note detect and assignor 14 for which only a single note is actuated, the same frequency number is stored in each of the three frequency number generators 503–505. Because of the ADSR generator actions only one tone generator will provide an output signal. When the second chord of two notes is actuated, frequency number register 503 will receive the highest frequency number of the new chord while both frequency number registers 504 and 505 will both receive the same frequency number corresponding to the lowest note of the actuated chord. Only the tone generators associated with note clocks 515 and 516 will receive an ADSR signal which causes the production of a tone. In this case both of the new notes will have a portamento transition which slides in frequency from the frequency of the first single actuated note.

Case 3: In this case both the first and second chords contain two notes. When the first two note chord is actuated, frequency number register 503 will contain the frequency corresponding to the highest note while frequency number registers 504 and 505 will both contain the frequency number for the lowest note in the chord. When the second chord of two notes is actuated, frequency number register 503 will again receive the frequency number for the highest frequency note while both frequency number registers 504 and 505 will each receive the frequency number for the lowest frequency note. The net result is a two note portamento frequency transition with no cross over. A cross over is said to exist, for example, if the highest first chord note transits to the lowest second chord note while the lowest first chord note transits to the highest second chord note. Such cross over transitions create harsh musical dissonants which are avoided by means of this invention.

Case 4: In this case a two note chord is followed by a one note chord. When the first two notes are actuated, the highest frequency number is stored in frequency number register 503 and the lowest frequency number is stored in both frequency number registers 504 and 505. When the second chord of one note is actuated, all three frequency number registers will store the same new frequency number. The result of this assignment is that the tone generators 521 and 522 originally assigned to the pair of notes for the first actuated chord will both start a portamento transition toward the frequency of the single note of the second chord. However, note generator 2 522 will enter its release phase of its ADSR envelope generator and may or may not complete its frequency transition depending upon the comparative ADSR release time and the preselected portamento transition time. These two time intervals are generally selected to be independent of each other. The net result is a transition of two notes to the second single note with the possibility that the transition from the lowest of the first note chord may not be completed. Even if this transition is completed the end tone will disappear because of the ADSR envelope function will go to zero for the tone generator 522.

Case 5: Case 5 is analogous to case 2 in that the transition to the second chord of three actuated notes will each start from the common frequency of the single note in the first chord. There will be no objectionable cross over frequency transitions.

Case 6: This is a transition from a two note chord to a three note chord. The first actuated two note chord places the highest frequency number in frequency number register 503 and then places the lowest frequency number in both frequency number registers 504 and 505. For the second three note chord the highest frequency number is stored in frequency number register 503, the middle frequency number is stored in frequency number register 504, and the lowest frequency number is stored in frequency number register 505. The net result is that the highest of the two notes of the first actuated chord will have a transition to the highest frequency of the second three note chord. The lowest frequency of the first chord will transit to the middle frequency of the second chord. The lowest frequency note of the second chord will provide a frequency transition starting from the lowest frequency note of the first chord. No frequency cross over transitions are generated.

Case 7: This case is analogous to the two note chords of case 3.

Case 8: This case is analogous to the action previously described for case 4.

Case 9: This case is that of a transition from a three note chord to a two note chord. As a result of the first actuated chord of three notes, the highest frequency number is stored in frequency number register 503, the middle frequency number is stored in frequency number register 504, and the lowest frequency number is stored in frequency number register 505. When the second chord of two notes is actuated, the highest frequency number is stored in frequency number register 503, and the lower frequency number is stored in both frequency number registers 504 and 505. The net result is the highest note of the first chord will transit to the highest note of the second chord. The middle note of the first chord will transit to the frequency of the lowest note of the second two note chord. The lowest note of the original set of three chords will start to transit to the lowest frequency of the second chord but this tone will disappear when its ADSR generator completes the release phase of the envelope function generation.

It is noted that in the portamento mode of operation, a note generator is permanently assigned to a corresponding frequency number register. Moreover, the contents of the frequency number register depends only upon the relative frequency of the actuated notes and does not depend upon prior note assignments which is the usual situation inplemented in many common types of note detect and assignment systems.

While the preferred embodiment of the invention is to scan the keyboards in the direction of decreasing frequency, it is obvious that the described logic will also operate if the scan direction is changed to the direction of increasing frequency.

The detailed logic of the portamento increment generator is shown in FIG. 4. This logic is essentially the same as that disclosed in the U.S. Pat. No. 4,103,581 entitled "Constant Speed Portamento." This patent is hereby incorporated by reference. The system blocks with 400 numbers in FIG. 4 correspond to the same numbered system blocks in the figure of the referenced patent.

OR-gate 526 provides a "1" logic state signal if either the signal state on line 85 or line 87 is a "1". The generation of these signals is described in the previously referenced U.S. Pat. No. 4,022,098. Line 85 will be in a "1" logic state if the assignor subsystem finds that a keyswitch is closed (actuated) and has been in the closed state on the immediate prior keyboard scan. Line 87 will be in a "1" state if a scan shows that a keyswitch has been actuated but was not actuated on the immediate prior scan. This is called a new switch closure. The output of AND-gate 420 is used to set the flip-flop 422. This flip-flop will be set if the PORTAMENTO ON signal is present, if the assigned counter is in its initial state, and if either a new keyswitch closure has been detected or if an old keyswitch closure is still in the closed state. It is recalled that the assigned counter 501 is reset to its initial state at the start of a scan for the keyboard operated in the portamento mode. The PORTAMENTO ON signal is a logic state provided by a console switch which places the keyboard in the portamento operation mode.

FIG. 4 only shows the details for one of the three portamento control means. The other two states of the assigned counter 501 are used in an analogous fashion to set flip-flops in the other portamento control means.

The frequency number register 503 in FIG. 4 serves the same function as the holding register 408 in the figure of the referenced Pat. No. 4,103,581.

The instantaneous frequency number that is used to control the frequency of the note clock 515 is contained in the accumulator 410.

When flip-flop 422 is set, the output Q state turns on the gate 424. The gate 424 transfers timing signals from a portamento clock 426 to a portamento counter 428. The modulo counting action of the portamento counter 428 determines the number of frequency steps that are implemented in a frequency transition from one note to the next note. The frequency of the portamento clock is made variable under control of the musician as it determines the length of time required for a frequency transition between two notes. The portamento counter is initialized at the same time that flip-flop 422 is set.

Whenever the portamento counter is incremented to its maximum count condition, a RESET signal is generated which resets the flip-flop 422 and thereby inhibits further timing signals to reach the portamento counter 428 from the portamento clock 426.

The RESET signal is transferred via the OR-gate 416 to the gate 412. When the input control signal to gate 412 is in a "1" logic state, the frequency number contained in the frequency number register 503 is transferred to the accumulator 410.

To provide an incremental change in frequency during the transition from one note to another during the counting phase of the portamento counter 428, the frequency number of the newly actuated keyswitch now in the frequency number register 503 is compared with the prior frequency number contained in accumulator 410 in a subtract and shift 430. The subtract and shift 430 generates the difference between its two input frequency numbers and in effect divides the difference by 64 by shifting the binary number in the accumulator to the right for six bit positions. The generated incremental value from subtract and shift 430 is stored in the increment register 432 whenever the flip-flop 422 is set so that gate 434 can transfer its input data.

The contents of the increment register 432 are added to the accumulator 410 (or subtracted depending upon the SIGN) by an adder 436. The output of adder 436 is coupled back to the accumulator 410 through the AND-gate 438 in response to the clock pulses generated by the portamento clock 426. The AND-gate 438 also senses if the gate 412 is "off", as indicated by the output of the inverter 440 connected to the output of the OR-gate 416.

An automatic glissando consisting of frequency increments of semi-tones can be implemented by a simple change in the logic shown in FIG. 4. Instead of having the subtract and shift 430 generate a frequency increment by a right binary shift operation, the frequency increment can be generated by multiplying the calculated frequency difference by a constant factor. A multiplying factor of the constant 1.05946 will produce an increasing chromatic glissando and a multiplying factor of the constant 0.94387 will produce decreasing chromatic glissando. The selection of the constants is controlled by the comparator contained in the subtract and shift 430. The up glissando is generated if the comparator indicates a positive or zero frequency number difference and the down glissando is generated if the comparator indicates a negative frequency number difference.

We claim:

1. In a keyboard operated electronic musical instrument having a keyboard containing a plurality of keyswitches, each operable in either an actuated or unactuated switch state, and having a number of tone generators operated at musical frequencies determined by a frequency number selected in response to an actuated keyswitch, apparatus for assigning the frequency numbers according to a priority logic whereby polyphonic portamento frequency effects are produced without frequency cross over transitions comprising;

a frequency number memory means for storing a table of frequency numbers, detection means for scanning said plurality of keyswitches in each of a sequence of keyswitch scans wherein a detection signal is generated for each keyswitch in an actuated keyswitch state, frequency addressing means for accessing a frequency number from said frequency number memory means in response to said detection signal, a plurality of frequency storage means each of which corresponds to one of said number of tone generators, an assignor means for storing a frequency number accessed from said frequency number memory means in a multiplicity of said plurality of frequency storage means according to said priority logic, and a plurality of portamento control means each of which corresponds to one of said number of tone generators, for producing said polyphonic portamento frequency effects in response to frequency numbers stored in said plurality of frequency storage means.

2. Apparatus according to claim 1 wherein said detection means comprises;

an encoding means whereby said detection signal is encoded to identify each said keyswitch in an actuated keyswitch state, state change detection means responsive to the keyswitch state changes of said plurality of keyswitches for each scan in said sequence of keyswitch scans wherein a closure signal is generated in response to each keyswitch whose keyswitch state changes from an unactuated switch state to an actuated switch state, and start circuitry for generating a start signal corresponding to each keyswitch scan in said sequence of keyswitch scans.

3. Apparatus according to claim 1 wherein said frequency addressing means comprises;

decoding means for decoding said detection signal to generate a memory address number associated with a corresponding keyswitch operated in an actuated keyswitch state, and address circuitry responsive to said memory address number whereby a frequency number is accessed from said frequency memory means.

4. Apparatus according to claim 3 wherein said assignor means comprises;

priority logic means whereby a frequency number accessed from said frequency number memory means is stored in each of a multiplicity of said plurality of frequency storage means, wherein said multiplicity is equal to a number $N+1-J$, where N is said number of tone generators, and J is an index number initiated to a zero value for each scan in said sequence of keyswitch scans, and J is incremented in value in response to each said generated closure signal.

5. Apparatus according to claim 4 wherein said priority logic means comprises;

a counter incremented by said closure signal for generating said index number J, reset circuitry for resetting said counter to an initial count state in response to said start signal, a gate means whereby said closure signal is not provided to said counter if the counter state is equal to said number N, and assignment addressing means responsive to said closure signal whereby the frequency number accessed from said frequency number means is stored in each of a number $N+1-J$ of said plurality of frequency storage means.

6. Apparatus according to claim 5 wherein said plurality of frequency storage means are each identified by a memory number M where $M=1,2,\ldots,N$ and said assignment addressing means comprises assignment circuitry whereby the frequency number accessed from said frequency number means is stored in a multiplicity of said frequency storage means having a memory number M lying in the numerical range $1,2,\ldots,N+1-J$.

7. Apparatus according to claim 4 wherein said priority logic means comprises;

a counter incremented by said closure signal wherein the count state of said counter is said priority index number J, reset circuitry whereby said counter is initialized to an initial count state in response to said start signal, a gate means whereby said closure signal is not provided to increment said count if said count state is equal to said number N, and assignment addressing means responsive to said closure signal whereby the frequency number accessed from said frequency number means is stored in each of a number $N+1-J$ of said plurality of frequency storage means.

8. Apparatus according to claim 7 wherein said plurality of frequency storage means are each identified by memory a number M where $M=1,2,\ldots,N$ and said assignment addressing means comprises assignment circuitry whereby a frequency number accessed from said frequency number means is stored in a multiplicity of said frequency storage means having a memory number M lying in the numerical range of $1,2,\ldots,N+1-J$.

9. Apparatus according to claim 2 wherein each selected member of said plurality of portamento control means comprises;

an accumulator means for storing a frequency number, subtraction means for subtracting said frequency number stored in a member of said plurality of frequency storage means corresponding to a selected member of said plurality of portamento control means from the frequency number stored in said accumulator means, incrementing means responsive to said closure signal and to said subtraction means for periodically changing the frequency number stored in said accumulator means according to a predetermined fraction of the output of said subtraction means, increment gating means whereby said incrementing means is interrupted when the frequency number stored in the accumulator means has been incremented a predetermined number of times, and tone generator means for generating a musical tone having a fundamental frequency corresponding to the frequency number stored in said accumulator means.

10. Apparatus according to claim 9 wherein said incrementing means comprises;

a transition time clock generator for generating timing signals, and synchronizing means responsive to said timing signals for synchronizing the changing of the frequency number stored in said accumulator means.

11. Apparatus according to claim 9 wherein said incrementing means comprises;

an increment multiplier means whereby the frequency number stored in said accumulator means is changed by multiplying it by the constant multiplier value $2^{1/12}$ if the output of said subtraction means is equal to or greater than a zero value and whereby the frequency number stored in said accumulator means is changed by multiplying it by the constant multiplier value $2^{-1/12}$ if the output of said subtraction means is less than a zero value thereby causing the corresponding tone generator to produce a glissando frequency change.

12. Apparatus according to claim 10 wherein said transition time clock generator comprises;

a transition counter incremented by said timing signals, a clock gate whereby said timing signals are not provided to said transition counter when the state of the transition counter has been incremented to a preselected count state, and gate reset means responsive to said closure signal and said assignor means whereby said transition counter is reset to an initial count state.

13. Apparatus according to claim 12 further comprising means for transferring said frequency number stored in a member of said plurality of frequency storage means directly into said accumulator means when said transition counter has been incremented to its said preselected count state.

14. In a keyboard operated electronic musical instrument having a keyboard containing a plurality of keyswitches, each operable in either an actuated or an unactuated switch state, and having a number of tone generators operated at musical frequencies determined by a frequency number selected in response to an actuated keyswitch, apparatus for assigning the frequency numbers according to a priority logic whereby polyphonic portamento frequency effects are produced without frequency cross over transitions comprising;

a frequency number means for storing a table of frequency numbers, a detection means for scanning said plurality of keyswitches in each of a sequence of keyswitch scans wherein a detection signal is generated corresponding to each keyswitch operated in an actuated switch state, an encoding means whereby said detection signal is encoded to form an encoded detection signal which identifies each said corresponding keyswitch operated in an actuated switch state, a state change detection means wherein a closure signal is generated for each keyswitch in said plurality of keyswitches whose switch state changes from an unactuated switch state to an actuated switch state, start circuitry for generating a start signal corresponding to each keyswitch scan in said sequence of keyswitch scans, addressing means responsive to said encoded detection signal whereby a frequency number is accessed from said frequency number means, a plurality of frequency storage means each of which corresponds to one of said number of tone generators, a priority logic means whereby a frequency number accessed from said frequency number means is stored in each of a number $N+1-J$ of said plurality of frequency storage means, where N is the number of said tone generators and J is a storage priority index number, thereby causing said portamento frequency effects to be produced without frequency cross over transitions, and a plurality of portamento control means, each of which corresponds to one of said number of tone generators, for producing said portamento frequency effects in response to frequency numbers stored in said plurality of frequency storage means.

15. Apparatus according to claim 14 wherein each one os said plurality of portamento control means comprises;

an accumulator means for storing a frequency number, subtraction means for subtracting a frequency number stored in a corresponding one of said plurality of frequency storage means from the frequency number stored in said accumulator means to generate a frequency increment number, and an increment multiplier means whereby the frequency number stored in said accumulator means is changed by multiplying it by the constant multiplier value $2^{1/12}$ if said frequency increment number is equal to or greater than a zero value and whereby the frequency number stored in said accumulator means is changed by multiplying it by the constant multiplier value $2^{-1/12}$ if said frequency increment number is less than a zero value thereby causing the corresponding tone generator to produce glissando frequency change transition.

* * * * *